US010533516B2

(12) United States Patent
Shigematsu et al.

(10) Patent No.: US 10,533,516 B2
(45) Date of Patent: Jan. 14, 2020

(54) INTERNAL COMBUSTION ENGINE

(71) Applicant: HONDA MOTOR CO., LTD., Minato-Ku, Tokyo (JP)

(72) Inventors: Keita Shigematsu, Wako (JP); Nobuyuki Kishi, Wako (JP); Takashi Kaneishi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 52 days.

(21) Appl. No.: 15/901,936

(22) Filed: Feb. 22, 2018

(65) Prior Publication Data

US 2018/0283317 A1 Oct. 4, 2018

(30) Foreign Application Priority Data

Mar. 30, 2017 (JP) ..... 2017-068893

(51) Int. Cl.

| | |
|---|---|
| ***F01L 1/02*** | (2006.01) |
| ***F02F 7/00*** | (2006.01) |
| ***F01L 1/047*** | (2006.01) |
| *F01L 1/18* | (2006.01) |
| *F02N 11/00* | (2006.01) |

(52) U.S. Cl.

CPC ..... *F02F 7/0043* (2013.01); *F01L 1/047* (2013.01); *F01L 1/18* (2013.01); *F02N 11/00* (2013.01)

(58) Field of Classification Search

CPC . F01L 1/047; F01L 1/18; F02F 7/0043; F02N 11/00

USPC ..... 123/90.31, 90.38, 90.17, 90.27

See application file for complete search history.

(56) References Cited

U.S. PATENT DOCUMENTS 7,814,874 B2 * 10/2010 Kubani ..... F01L 1/344 123/90.17

FOREIGN PATENT DOCUMENTS

| | | | |
|---|---|---|---|
| EP | 1403513 | A1 | 3/2004 |
| GB | 2317705 | A | 4/1998 |
| JP | 2014-055544 | A | 3/2014 |

OTHER PUBLICATIONS

Extended European search report dated Aug. 16, 2018, issued over the corresponding EP Patent Application No. 18158303.0.

* cited by examiner

*Primary Examiner* — Ching Chang

(74) *Attorney, Agent, or Firm* — Carrier Blackman & Associates, P.C.; Joseph P. Carrier; William D. Blackman

(57) ABSTRACT

An internal combustion engine includes: a crankcase that supports a crankshaft rotatably about a rotational axis; a cylinder block connected with the crankcase and including at least one pair of cylinders that sandwich a valve chamber therebetween in an axial direction of the crankshaft, the valve chamber housing therein a valve actuating mechanism that connects a camshaft to the crankshaft; a detected member disposed between crank pins corresponding to the pair of cylinders, the detected member rotating integrally with the crankshaft; and a detection sensor disposed to face a trajectory of the detected member and generating a pulse signal in accordance with movement of the detected member. Accordingly, the internal combustion engine can avoid displacement of a nearby part and enlargement of the crankcase as much as possible, while allowing the detected member to be increased in size.

12 Claims, 6 Drawing Sheets

INTERNAL COMBUSTION ENGINE

BACKGROUND OF THE INVENTION

Field of the Invention

The present invention relates to an internal combustion engine, comprising a cylinder block connected with a crankcase and including at least one pair of cylinders that sandwich a valve chamber therebetween in an axial direction of the crankshaft, the valve chamber housing therein a valve actuating mechanism that connects a camshaft to the crankshaft.

Description of the Related Art

Japanese Patent Application Laid-open No. 2014-055544 discloses an internal combustion engine. The internal combustion engine includes a plurality of cylinders arranged in series with each other in an axial direction of a crankshaft. A pulser rotor (detected member) is mounted on a shaft end of the crankshaft.

The outside diameter of a pulser rotor needs to be increased before detection accuracy of a crank angle can be enhanced. The pulser rotor, when having a large outside diameter on the shaft end of the crankshaft, interferes with a nearby part or the crankcase, leading to displacement of the nearby part or an enlarged crankcase.

SUMMARY OF THE INVENTION

The present invention has been achieved in view of the above-mentioned circumstances and it is an object of the present invention to provide an internal combustion engine that can avoid displacement of a nearby part and an increased size of a crankcase as much as possible, while allowing a detected member to be increased in size.

In order to achieve the object, according to a first aspect of the present invention, there is provided an internal combustion engine, comprising: a crankcase that supports a crankshaft rotatably about a rotational axis; a cylinder block connected with the crankcase and including at least one pair of cylinders that sandwich a valve chamber therebetween in an axial direction of the crankshaft, the valve chamber housing therein a valve actuating mechanism that connects a camshaft to the crankshaft; a detected member disposed between crank pins corresponding to the pair of cylinders, the detected member rotating integrally with the crankshaft; and a detection sensor disposed to face a trajectory of the detected member and generating a pulse signal in accordance with movement of the detected member.

With the first aspect, the detected member is disposed in an empty space available around the valve chamber. Interference between the detected member and a nearby part or the crankcase can thus be avoided. Hence, displacement of the nearby part or enlargement of the crankcase can be avoided regardless of whether the detected member is enlarged. The internal combustion engine can thus be suppressed from being enlarged.

According to a second aspect of the present invention, in addition to the first aspect, the detected member is fixed to the crankshaft inside the valve chamber.

With the second aspect, the detected member can be compactly housed inside the valve chamber.

According to a third aspect of the present invention, in addition to the first or second aspect, the crankshaft includes a flange that expands in a radial direction so as to receive the detected member which is to be fastened to the flange.

With the third aspect, the detected member can be fixed to the crankshaft, while an increase in weight of the crankshaft is minimized.

According to a fourth aspect of the present invention, in addition to the first aspect, the detected member is fixed to the crankshaft between either one of the crank pins and a wall of the crankcase, the wall facing the one crank pin so as to define the valve chamber.

With the fourth aspect, the detected member is adjacent to the valve chamber so as to be able to be compactly housed in a crank chamber.

According to a fifth aspect of the present invention, in addition to the fourth aspect, the detected member is placed on a crank web of the crankshaft and fastened to the crank web by a fastener.

With the fifth aspect, the detected member can be fixed to the crankshaft without the need to add a new structure unique to the detected member, such as the flange. This avoids a considerable change in the structure of the crankshaft.

According to a sixth aspect of the present invention, in addition to the first or second aspect, the detected member includes a first partial annular unit that has a cutout larger than a shaft diameter of the crankshaft and a second partial annular unit that is incorporated into the cutout of the first partial annular unit to thereby constitute a single continuous annular unit around the crankshaft.

With the sixth aspect, the annular detected member is divided into the first partial annular unit and the second partial annular unit. Thus, the detected member can still be mounted on the crankshaft even under a condition in which the crankshaft has been assembled to the crankcase.

According to a seventh aspect of the present invention, in addition to the first or second aspect, there is provided the internal combustion engine, further comprising a transmission housed in the crankcase and connected with the crankshaft, wherein the detection sensor is mounted on the crankcase around the rotational axis and between the cylinder block and the transmission.

With the seventh aspect, the internal combustion engine includes the transmission housed in the crankcase and is thereby configured as a power unit integrated with the transmission. At this time, an empty space is formed between the cylinder block and the transmission around the rotational axis of the crankshaft. The detection sensor is disposed in this empty space, so that the detection sensor can be disposed as close as possible to the crankshaft. The detected member thus can have an outside diameter as small as possible. This feature can avoid an increase in size of the detected member as a result of restrictions on disposing the detection sensor.

According to an eighth aspect of the present invention, in addition to the seventh aspect, there is provided the internal combustion engine, further comprising a starter motor mounted on the crankcase around the rotational axis, between the cylinder block and the transmission and at a position offset from the detection sensor in an axial direction of the rotational axis.

With the eighth aspect, the detection sensor, though being disposed between the cylinder block and the transmission, is mounted on the crankcase at a position displaced in the axial direction of the rotational axis from the starter motor that is similarly mounted on the crankcase between the cylinder block and the transmission. This arrangement avoids interference between the detection sensor and the starter motor and allows the detection sensor and the starter motor to be compactly disposed within the empty space.

The above and other objects, characteristics and advantages of the present invention will be clear from detailed descriptions of the preferred embodiments which will be provided below while referring to the attached drawings.

DESCRIPTION OF THE PREFERRED EMBODIMENTS

Embodiments of the present invention will be described below with reference to the accompanying drawings. It is here noted that up and down, front and rear, and right and left of a vehicle body are directions when viewed by an occupant riding on a two-wheeled motor vehicle.

Figure 1:
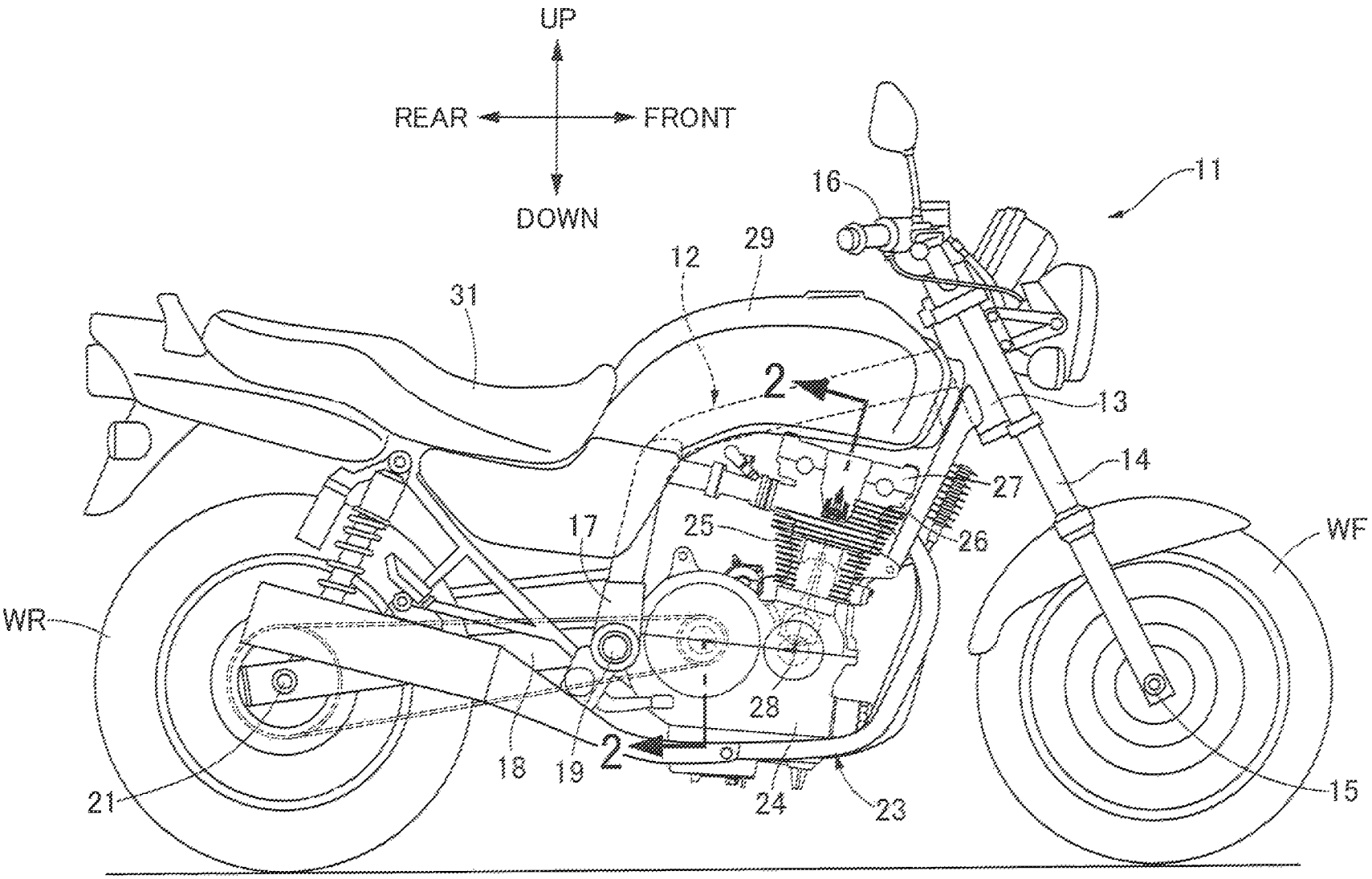
FIG. 1 is a side view schematically depicting an entire configuration of a two-wheeled motor vehicle according to an embodiment of the present invention.

FIG. 1 schematically depicts an entire configuration of a two-wheeled motor vehicle (saddle-ridden vehicle) according to an embodiment of the present invention. This two-wheeled motor vehicle 11 includes a vehicle body frame 12. A front fork 14 is steerably supported on a head pipe 13 at a front end of the vehicle body frame 12. The front fork 14 supports a front wheel WF rotatably about an axle 15. A handlebar 16 is connected with the front fork 14 at a position above the head pipe 13. A swing arm 18 is supported swingably about a pivot shaft 19 that extends horizontally in a vehicle width direction by a pivot frame 17 at a position behind the vehicle body frame 12. A rear wheel WR is supported rotatably about an axle 21 at a rear end of the swing arm 18.

An internal combustion engine 23 is mounted on the vehicle body frame 12 between the front wheel WF and the rear wheel WR. The internal combustion engine 23 includes a crankcase 24, a cylinder block 25, a cylinder head 26, and a head cover 27. The cylinder block 25 is connected with the crankcase 24 and extends upward from the crankcase 24 to thereby have a forwardly inclined cylinder axis. The cylinder head 26 is connected with the cylinder block 25. The head cover 27 is connected with the cylinder head 26. The crankcase 24 houses a crankshaft (to be described later) that rotates about a rotational axis 28 that extends in parallel with the axle 21 of the rear wheel WR. Rotating motion of the crankshaft is transmitted to the rear wheel WR by way of a transmission apparatus (not depicted).

A fuel tank 29 is mounted on the vehicle body frame 12 at a position above the internal combustion engine 23. An occupant seat 31 is mounted on the vehicle body frame 12 at a position behind the fuel tank 29. Fuel is supplied from the fuel tank 29 to a fuel injection device of the internal combustion engine 23. In operating the two-wheeled motor vehicle 11, the occupant straddles the occupant seat 31.

Figure 2:
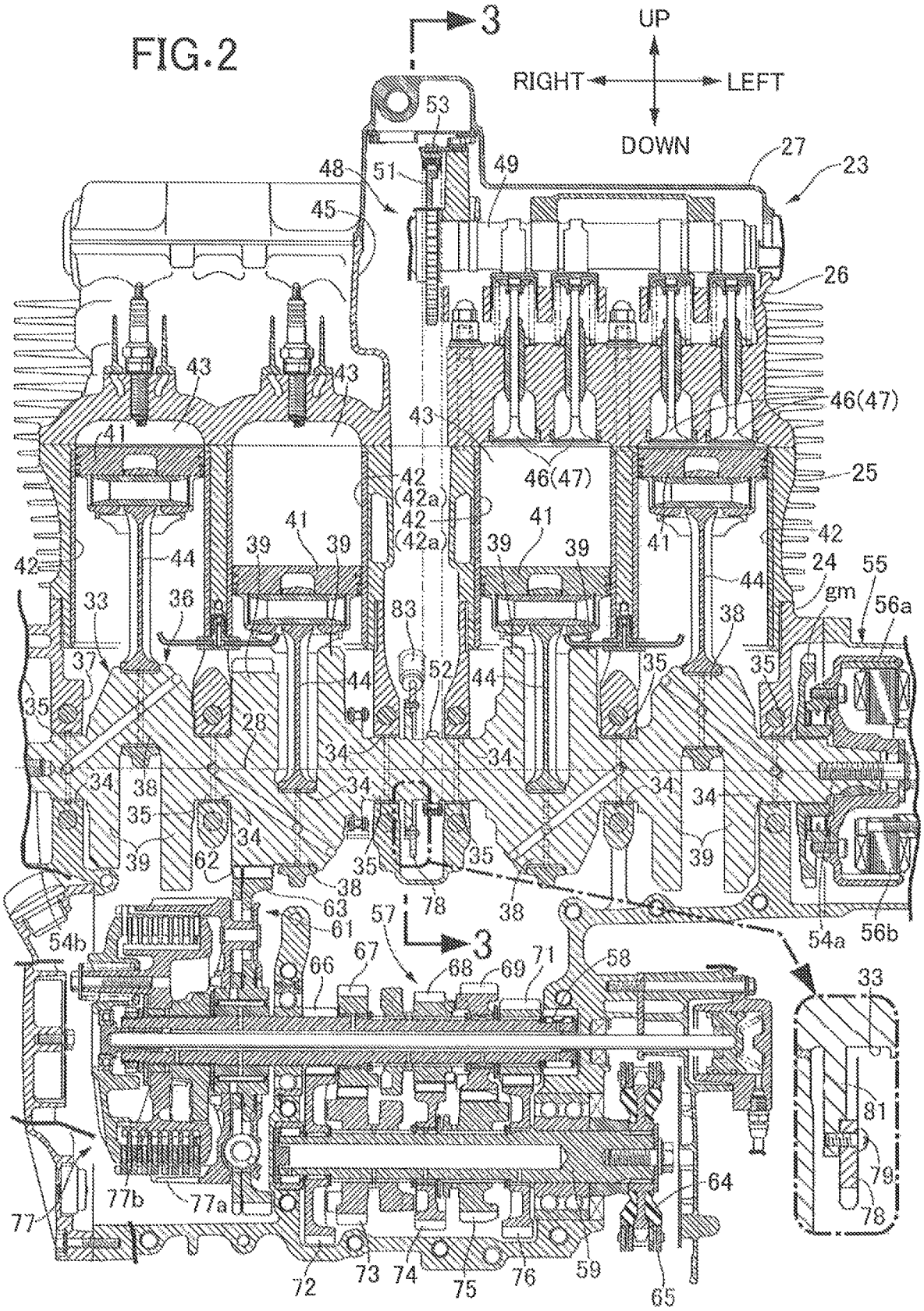
FIG. 2 is an enlarged partial sectional view of the two-wheeled motor vehicle, taken along line 2-2 in FIG. 1.

Reference is made to FIG. 2. The internal combustion engine 23 according to a first embodiment includes a crankshaft 33. The crankshaft 33 is supported in the crankcase 24 rotatably about the rotational axis 28. The crankshaft 33 includes journals 35 that are coupled with bearings 34 rotatably about an axis. The journals 35 each have an axis aligned with the rotational axis 28.

A crank 36 of the crankshaft 33 is housed in a crank chamber 37 defined between two journals 35 in the crankcase 24. The crank 36 includes a crank pin 38 and crank webs 39. The crank pin 38 has an axis parallel with the rotational axis 28 at a position offset radially from the rotational axis 28. The crank webs 39 support opposite ends of the crank pin 38, the respective journals 35 being connected to the crank webs 39.

The internal combustion engine 23 includes a piston 41 incorporated in the cylinder block 25. The piston 41 is housed in a cylinder 42 defined in the cylinder block 25. A combustion chamber 43 is defined between the piston 41 and the cylinder head 26.

A connecting rod 44 has a small end portion connected with the piston 41. The connecting rod 44 has a large end portion connected with the crank pin 38 of the crankshaft 33. The connecting rod 44 translates axial motion of the piston 41 to rotational motion of the crankshaft 33.

The cylinder block 25 includes at least one pair of cylinders 42 (42*a*). The cylinders 42 (42*a*) sandwich a valve chamber 45 therebetween in the axial direction of the rotational axis 28. Here, the cylinder block 25 includes four cylinders 42 arranged in series with each other in the axial direction of the rotational axis 28. The valve chamber 45 is disposed between the pair of cylinders 42*a* at the center.

The internal combustion engine 23 includes intake valves 46 and exhaust valves 47 supported by the cylinder head 26. The intake valve 46 and the exhaust valve 47 open and close an intake port and an exhaust port, respectively, opening to the combustion chamber 43. A valve actuating mechanism 48 is connected with the intake valve 46 and the exhaust valve 47. The valve actuating mechanism 48 includes a camshaft 49, a follower sprocket 51, a drive sprocket 52, and a cam chain or endless member 53. The camshaft 49 is supported by the cylinder head 26 rotatably about an axis parallel with the rotational axis 28. The follower sprocket 51 is housed in the valve chamber 45 and fixed to the camshaft 49. The drive sprocket 52 is housed in the valve chamber 45 and fixed to the crankshaft 33. The cam chain 53 is wound around the drive sprocket 52 and the follower sprocket 51. The cam chain 53 transmits rotational drive power of the drive sprocket 52 to the follower sprocket 51. The rotational power of the camshaft 49 is translated to axial displacement of the intake valve 46 and the exhaust valve 47 via a rocker arm (not depicted).

The crankshaft 33 includes a first drive shaft 54*a* and a second drive shaft 54*b*. The first drive shaft 54*a* protrudes outward to one side in the axial direction from the crankcase 24. The second drive shaft 54*b* protrudes outward to an other side in the axial direction from the crankcase 24. An alternating-current generator (ACG) 55 is connected with the first drive shaft 54*a*. The ACG 55 includes a rotor 56*a* and a stator 56*b*. The rotor 56*a* is connected relatively unrotatably with the first drive shaft 54*a* protruding from the crankcase 24. The rotor 56*a* includes a plurality of magnets arrayed in a peripheral direction. The rotor 56*a* surrounds an outer periphery of the stator 56*b*. A plurality of coils arrayed in the peripheral direction are wound around the stator 56*b*.

The coils follow a trajectory that faces a trajectory of the magnets during rotation of the rotor 56*a*. A drive gear of a gear mechanism gm is mounted on the first drive shaft 54*a*. A starter motor (not depicted in FIG. 2; to be described later) is connected with the gear mechanism gm, so that a rotating force during starting is transmitted to the gear mechanism gm.

A dog clutch type multi-stage transmission 57 is incorporated in the internal combustion engine 23. The multi-stage transmission 57 includes an input shaft 58 and an output shaft 59 having axes parallel with the axis of the crankshaft 33. The input shaft 58 and the output shaft 59 are supported rotatably via bearings in the crankcase 24. A primary speed-reduction mechanism 61 is disposed between the crankshaft 33 and the input shaft 58. The primary speed-reduction mechanism 61 includes a drive gear 62 and a driven gear 63. The drive gear 62 is integrated with the crank web 39. The driven gear 63 is supported relatively rotatably on the input shaft 58. The driven gear 63 meshes with the drive gear 62.

A drive sprocket 64 of the transmission apparatus is connected with the output shaft 59. A drive chain 65 is wound around the drive sprocket 64. The drive chain 65 transmits rotational power of the drive sprocket 64 to the rear wheel WR.

Five drive gears are disposed on the input shaft 58. The drive gears include, in sequence, a low drive gear 66, a fourth-speed drive gear 67, a third-speed drive gear 68, a fifth-speed drive gear 69, and a second-speed drive gear 71. Similarly, five driven gears are disposed on the output shaft 59. The driven gears include, in sequence, a low driven gear 72, a fourth-speed driven gear 73, a third-speed driven gear 74, a fifth-speed driven gear 75, and a second-speed driven gear 76. The multi-stage transmission 57 selectively switches a connected state from among a neutral state, a first-speed connected state, a second-speed connected state, a third-speed connected state, a fourth-speed connected state, and a fifth-speed connected state.

The primary speed-reduction mechanism 61 and the input shaft 58 are connected with each other via a friction clutch 77. The friction clutch 77 includes a clutch outer 77*a* and a clutch hub 77*b*. The driven gear 63 of the primary speed-reduction mechanism 61 is connected with the clutch outer 77*a*. To respond to an operation of a clutch lever, the friction clutch 77 switches a state from connection to disconnection, or vice versa, between the clutch outer 77*a* and the clutch hub 77*b*.

The internal combustion engine 23 includes a pulser ring (detected member) 78. The pulser ring 78 is disposed between the crank pins 38 corresponding to the pair of cylinders 42*a* which sandwich the valve chamber 45 therebetween. The pulser ring 78 rotates integrally with the crankshaft 33. Here, the pulser ring 78 is disposed between the journals 35 adjacent to each other in the valve chamber 45 and fixed to the crankshaft 33. The crankshaft 33 includes a flange 81. The flange 81 extends in a radial direction and receives the pulser ring 78 that is to be fastened to the flange with a screw 79.

Figure 3:
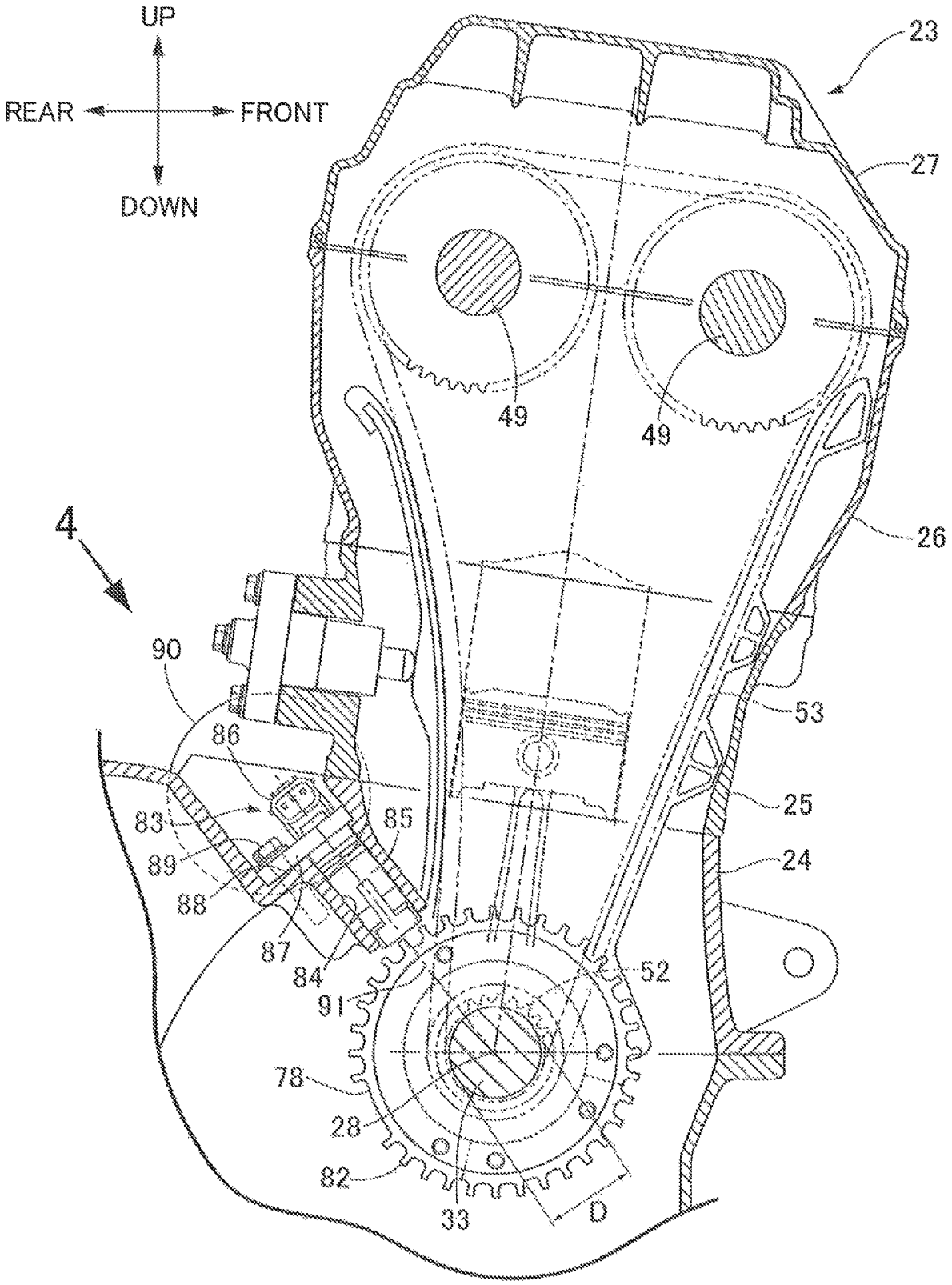
FIG. 3 is an enlarged partial sectional view of an internal combustion engine according to a first embodiment, taken along line 3-3 in FIG. 2.

Reference is made to FIG. 3. The pulser ring 78 is formed into an annular plate shape that rotates integrally with the crankshaft 33 coaxially about the rotational axis 28. The pulser ring 78 includes a plurality of reluctors 82. The reluctors 82 are annularly disposed at equidistant intervals around the rotational axis 28. The reluctors 82 are disposed, for example, at a central angle of ten degrees. The reluctors 82 are formed of, for example, a magnetic material.

The internal combustion engine 23 includes a pulser sensor (detection sensor) 83. The pulser sensor 83 faces an annular trajectory of the pulser ring 78 and generates a pulse signal in accordance with movement of the pulser ring 78. The pulser sensor 83 is mounted on the crankcase 24 around the rotational axis 28 and between the cylinder block 25 and the multi-stage transmission 57. The pulser sensor 83 includes a main unit 85, a coupler 86, and a fastening piece 87. The main unit 85 is inserted from the outside through a through hole 84 formed in an upper surface of the crankcase 24 at the back of the cylinder block 25. The main unit 85 has a detection portion at a tip end thereof, facing an internal space of the crankcase 24. The coupler 86 is connected with the main unit 85 and disposed in a space outside the crankcase 24. The fastening piece 87 is connected with the main unit 85 and is fastened with the crankcase 24. The through hole 84 has an axis oriented toward an axis of the second drive shaft 54*b*, that is, toward the rotational axis 28 of the crankshaft 33. The pulser sensor 83 outputs an electrical signal depending on presence of a magnetic material detected on the trajectory of the pulser ring 78. The pulser sensor 83 outputs a pulse signal that identifies an angular position of the crankshaft 33. An eddy-current micro displacement sensor may even be used for the pulser sensor 83.

The fastening piece 87 is placed on a base surface 88 formed on an upper surface of the crankcase 24 and fastened to the crankcase 24 using a bolt 89. The pulser sensor 83 has a detection axis 91 having the highest sensitivity. The detection axis 91 is oriented toward the rotational axis 28 of the crankshaft 33. The detection axis 91 is orthogonal to the rotational axis 28.

Figure 4:
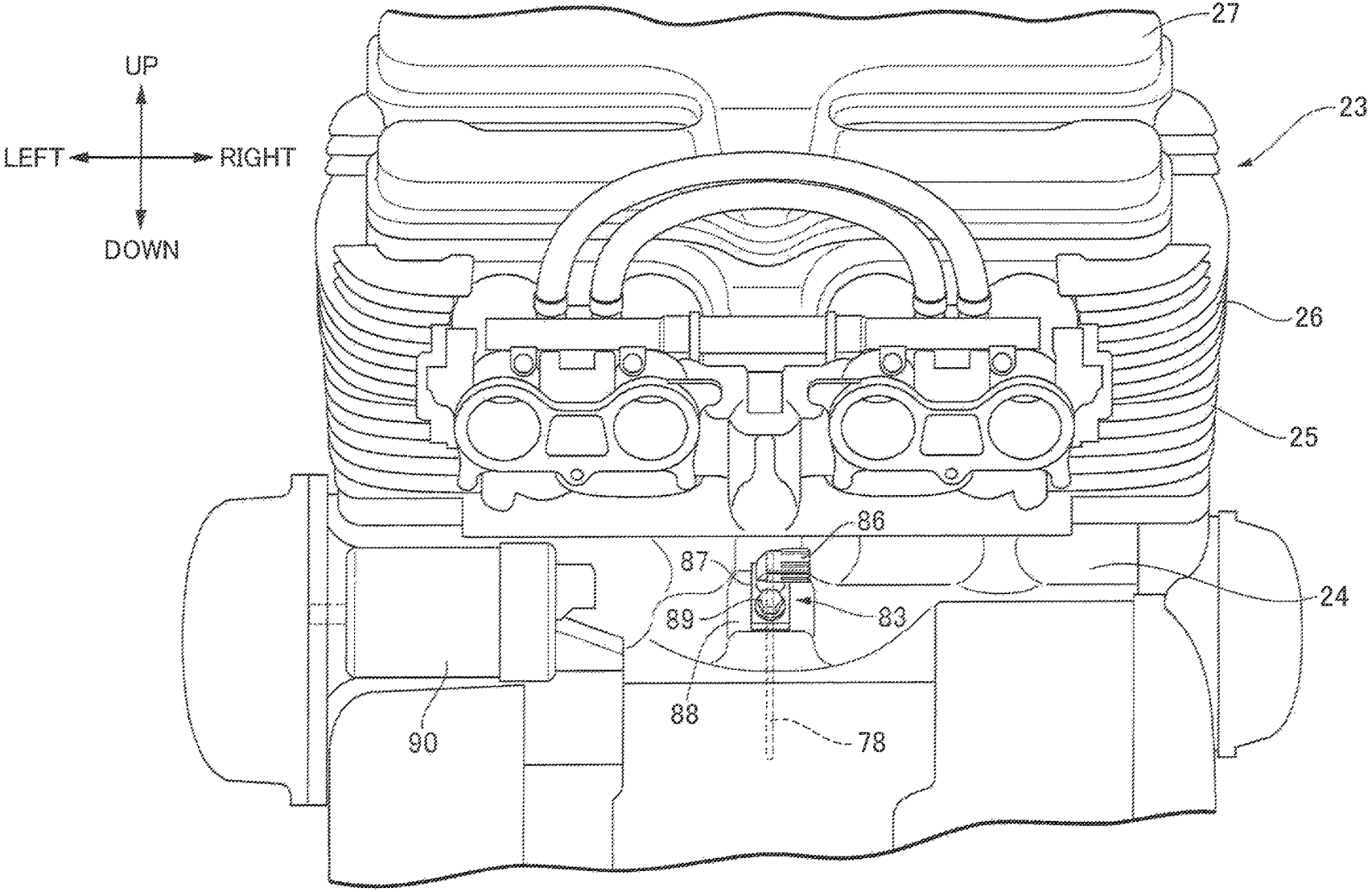
FIG. 4 is a view from arrow 4 in FIG. 3 and a rear view of the internal combustion engine as viewed from the rear of the two-wheeled motor vehicle.

As with the pulser sensor 83, a starter motor 90 is mounted from the outside on the crankcase 24 around the rotational axis 28 and between the cylinder block 25 and the multi-stage transmission 57. As depicted in FIG. 4, the starter motor 90 is disposed at a position offset from the pulser sensor 83 in the axial direction of the rotational axis 28.

Figure 5:
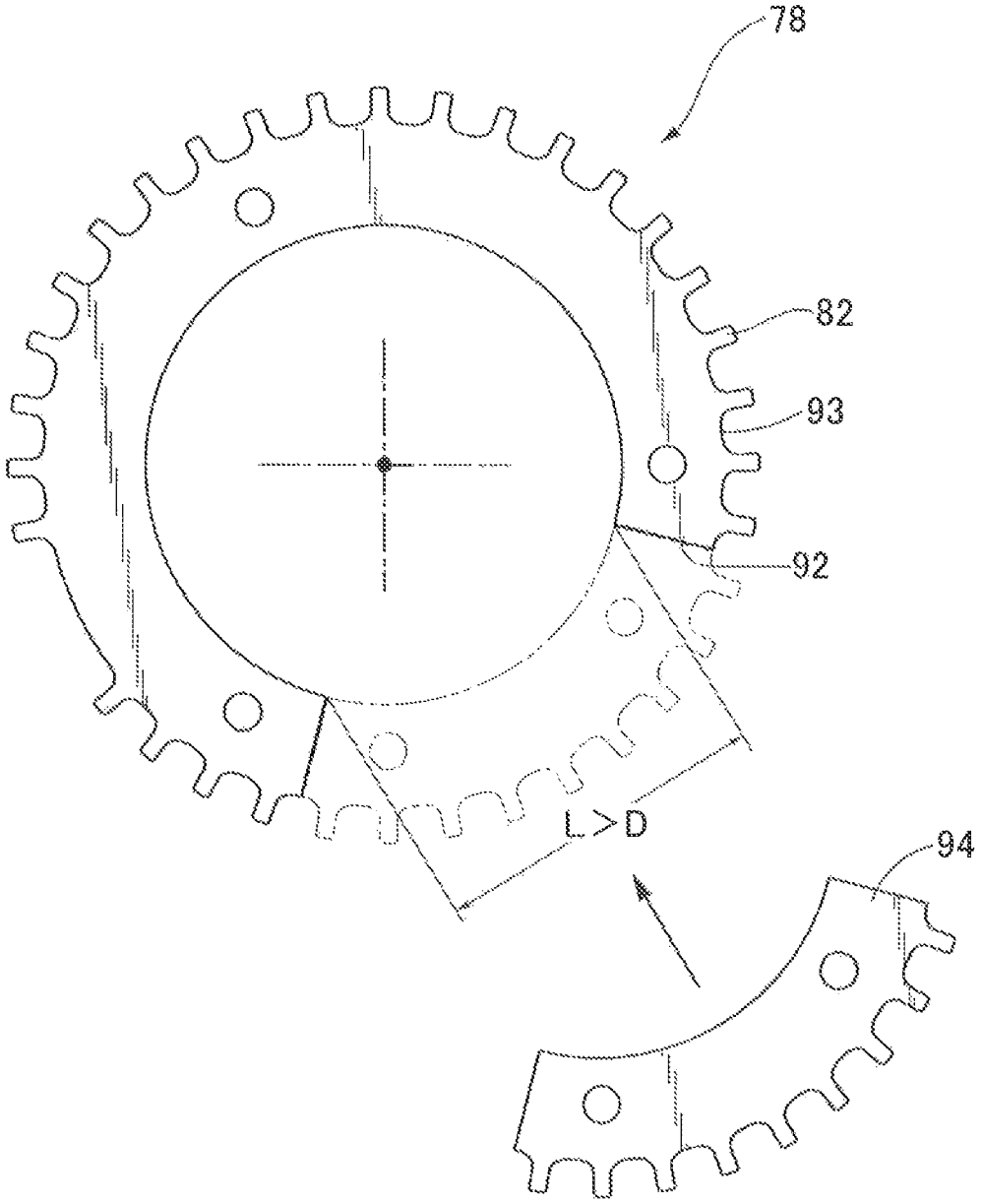
FIG. 5 is an enlarged exploded view of a pulser ring.

Reference is made to FIG. 5. The pulser ring 78 includes a first partial annular unit 93 and a second partial annular unit 94. The first partial annular unit 93 has a cutout 92 that is larger than a shaft diameter D (see FIG. 3) of the crankshaft 33. The second partial annular unit 94 is incorporated into the cutout 92 of the first partial annular unit 93 to thereby constitute a single continuous annular unit around the crankshaft 33. The cutout 92 of the first partial annular unit 93 has a linear distance L between end portions which is greater than the shaft diameter D of the crankshaft 33. The first partial annular unit 93 and the second partial annular unit 94 are individually fastened to the flange 81. At this time, preferably, step surfaces representing the first partial annular unit 93 and the second partial annular unit 94, for example, are formed in the flange 81.

Operation of the present embodiment will be described below. In the present embodiment, the pulser ring 78 is disposed between the crank pins 38 corresponding to at least one pair of cylinders 42*a* which sandwich the valve chamber 45 therebetween in the axial direction of the crankshaft 33. Because the pulser ring 78 is disposed in an empty space available around the valve chamber 45, interference between the pulser ring 78 and a nearby part or the crankcase 24 can be avoided. Thus, displacement of the nearby part or enlargement of the crankcase 24 can be avoided regardless of whether the pulser ring 78 is enlarged. The internal combustion engine 23 can thus be suppressed from being enlarged. In addition, the pulser ring 78 is fixed to the crankshaft 33 inside the valve chamber 45, so that the pulser ring 78 is compactly housed inside the valve chamber 45.

The pulser ring 78 in the present embodiment includes the first partial annular unit 93 that has the cutout 92 larger than the shaft diameter D of the crankshaft 33 and the second partial annular unit 94 that is incorporated into the cutout 92 of the first partial annular unit 93 to thereby constitute a single continuous annular unit around the crankshaft 33. The annular pulser ring 78, because being divided into the first partial annular unit 93 and the second partial annular unit 94, can still be mounted on the crankshaft 33 even under a condition in which the crankshaft 33 has been assembled to the crankcase 24.

The crankshaft 33 includes the flange 81. The flange 81 extends in the radial direction and receives the pulser ring 78 which is to be fastened to the flange 81. Thus, the pulser ring 78 can thus be fixed to the crankshaft 33, while an increase in weight of the crankshaft 33 is minimized.

The internal combustion engine 23 in the present embodiment houses the multi-stage transmission 57 in the crankcase 24 and is thereby configured as a power unit integrated with the transmission. At this time, an empty space is formed between the cylinder block 25 and the multi-stage transmission 57 around the rotational axis 28 of the crankshaft 33. The pulser sensor 83 is disposed in this empty space, so that the pulser sensor 83 can be disposed as close as possible to the crankshaft 33. The pulser ring 78 thus can have an outside diameter as small as possible. This feature can avoid an increase in size of the pulser ring 78 as a result of restrictions on disposing the pulser sensor 83.

In the internal combustion engine 23, the starter motor 90 is mounted on the crankcase 24 around the rotational axis 28, between the cylinder block 25 and the multi-stage transmission 57 and at a position offset from the pulser sensor 83 in the axial direction of the rotational axis 28. The pulser sensor 83, though being disposed between the cylinder block 25 and the multi-stage transmission 57, is mounted on the crankcase 24 at a position displaced in the axial direction of the rotational axis 28 from the starter motor 90 that is similarly mounted on the crankcase 24 between the cylinder block 25 and the multi-stage transmission 57. This arrangement avoids interference between the pulser sensor 83 and the starter motor 90 and allows the pulser sensor 83 and the starter motor 90 to be compactly disposed within the empty space.

Figure 6:
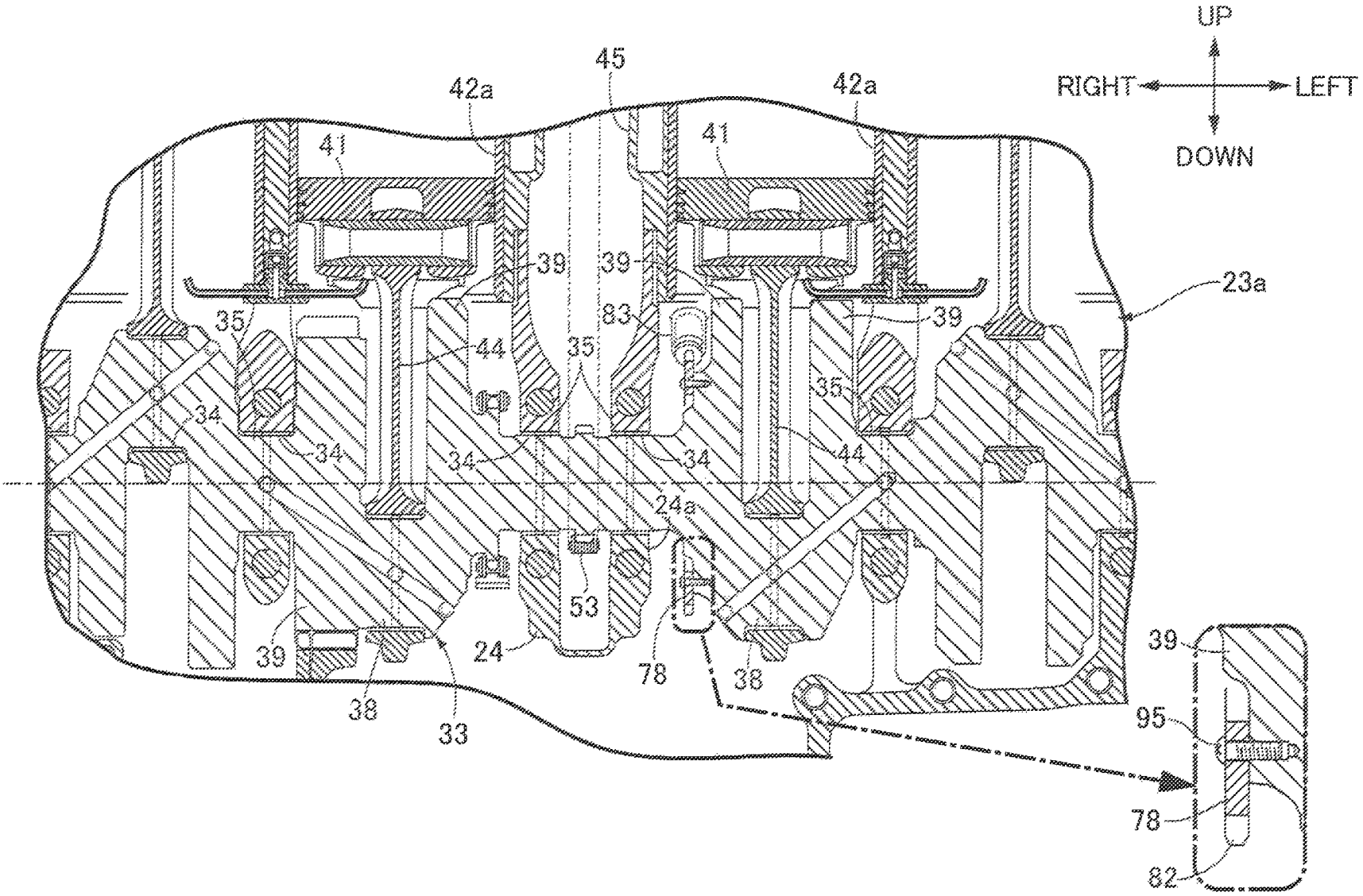
FIG. 6 is an enlarged partial sectional view of an internal combustion engine according to a second embodiment, corresponding to part of FIG. 2.

FIG. 6 schematically depicts a structure of an internal combustion engine 23*a* according to a second embodiment. The following describes only differences from the first embodiment. In the internal combustion engine 23*a* in the second embodiment, a pulser ring 78 is fixed to a crankshaft 33 between either one of crank pins 38 corresponding to a pair of cylinders 42*a* that sandwich a valve chamber 45 therebetween and a wall 24*a* of a crankcase 24, the wall 24*a* facing the one crank pin 38 and defining the valve chamber 45. The pulser ring 78 is placed on a crank web 39 of the crankshaft 33 and fastened to the crank web 39 by a fastener (screw) 95. As in the first embodiment, a pulser sensor 83 is mounted on the crankcase 24 around a rotational axis 28 and between a cylinder block 25 and a multi-stage transmission 57. The pulser sensor 83 faces an annular trajectory of the pulser ring 78. The pulser sensor 83 has a detection axis 91 having the highest sensitivity. The detection axis 91 is oriented toward the rotational axis 28 of the crankshaft 33. The detection axis 91 is orthogonal to the rotational axis 28.

In the second embodiment, the pulser ring 78 is fixed to the crankshaft 33 between the wall 24*a* of the crankcase 24 and either one of crank pins 38 corresponding to at least one pair of cylinders 42*a* that sandwich the valve chamber 45 therebetween in the axial direction of the crankshaft 33, the wall 24*a* facing the one crank pin 38 and defining the valve chamber 45. The pulser ring 78 is adjacent to the valve chamber 45 so as to be able to be compactly housed in a crank chamber 37.

The pulser ring 78 is placed on the crank web 39 of the crankshaft 33 and fastened to the crank web 39 using the fastener 95. This allows the pulser ring 78 to be fixed to the crankshaft 33 without the need to add a new structure unique to the pulser ring 78, such as the flange 81 as described above. This avoids a considerable change in the structure of the crankshaft 33.

What is claimed is:

1. An internal combustion engine, comprising:

a crankcase that supports a crankshaft rotatably about a rotational axis;

a cylinder block connected with the crankcase and including at least one pair of cylinders that sandwich a valve chamber therebetween in an axial direction of the crankshaft, the valve chamber housing therein a valve actuating mechanism that connects a camshaft to the crankshaft;

an annular member disposed between crank pins corresponding to the at least one pair of cylinders, the annular member rotating integrally with the crankshaft; and a detection sensor disposed to face a trajectory of the annular member and which generates a pulse signal in accordance with movement of the annular member, wherein the valve actuating mechanism includes the camshaft and an endless member which operatively connects the camshaft to the crankshaft.

2. The internal combustion engine according to claim 1, wherein the annular member is fixed to the crankshaft inside the valve chamber.

3. The internal combustion engine according to claim 2, wherein the crankshaft includes a flange that expands in a radial direction so as to receive the annular member which is to be fastened to the flange.

4. The internal combustion engine according to claim 2, wherein the annular member includes a first partial annular unit that has a cutout larger than a shaft diameter of the crankshaft and a second partial annular unit that is incorporated into the cutout of the first partial annular unit to thereby constitute a single continuous annular unit around the crankshaft.

5. The internal combustion engine according to claim 2, further comprising:

a transmission housed in the crankcase and connected with the crankshaft, wherein the detection sensor is mounted on the crankcase around the rotational axis and between the cylinder block and the transmission.

6. The internal combustion engine according to claim 5, further comprising:

a starter motor mounted on the crankcase around the rotational axis, between the cylinder block and the transmission and at a position offset from the detection sensor in an axial direction of the rotational axis.

7. The internal combustion engine according to claim 1, wherein the crankshaft includes a flange that expands in a radial direction so as to receive the annular member which is to be fastened to the flange.

8. The internal combustion engine according to claim 1, wherein the annular member is fixed to the crankshaft between either one of the crank pins and a wall of the crankcase, the wall facing the one crank pin so as to define the valve chamber.

9. The internal combustion engine according to claim 8, wherein the annular member is placed on a crank web of the crankshaft and fastened to the crank web by a fastener.

10. The internal combustion engine according to claim 1, wherein the annular member includes a first partial annular unit that has a cutout larger than a shaft diameter of the crankshaft and a second partial annular unit that is incorporated into the cutout of the first partial annular unit to thereby constitute a single continuous annular unit around the crankshaft.

11. The internal combustion engine according to claim 1, further comprising:

a transmission housed in the crankcase and connected with the crankshaft, wherein the detection sensor is mounted on the crankcase around the rotational axis and between the cylinder block and the transmission.

12. The internal combustion engine according to claim 11, further comprising:

a starter motor mounted on the crankcase around the rotational axis, between the cylinder block and the transmission and at a position offset from the detection sensor in an axial direction of the rotational axis.

* * * * *